US007322294B1

(12) United States Patent
Laib

(10) Patent No.: US 7,322,294 B1
(45) Date of Patent: Jan. 29, 2008

(54) INTEGRATED THIN FILM EXPLOSIVE MICRO-DETONATOR

(75) Inventor: Gerald Laib, Olney, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/362,596

(22) Filed: Feb. 24, 2006

Related U.S. Application Data

(62) Division of application No. 10/729,266, filed on Dec. 3, 2003.

(51) Int. Cl.
*F42C 15/184* (2006.01)

(52) U.S. Cl. ..... 102/254; 102/275.11

(58) Field of Classification Search ..... 102/275.11, 102/235, 244, 245, 246, 251, 254
See application file for complete search history.

(56) References Cited

U.S. PATENT DOCUMENTS

| | | | | |
|---|---|---|---|---|
| 2,296,901 | A * | 9/1942 | Brayton | 102/513 |
| 2,705,921 | A * | 4/1955 | Moseman, Jr. | 102/251 |
| 3,380,385 | A * | 4/1968 | Hazelet | 102/254 |
| 4,862,803 | A | 9/1989 | Nerheim et al. | 102/202.5 |
| 5,370,053 | A | 12/1994 | Williams et al. | 102/202.5 |
| 6,173,650 | B1 | 1/2001 | Garvick et al. | 102/202.5 |
| 6,178,888 | B1 | 1/2001 | Neyer et al. | 102/202.7 |
| 6,386,108 | B1 | 5/2002 | Brooks et al. | 102/217 |

* cited by examiner

*Primary Examiner*—Stephen M Johnson
(74) *Attorney, Agent, or Firm*—Fredric J. Zimmerman

(57) ABSTRACT

A method of making a thin film explosive detonator includes forming a substrate layer; depositing a metal layer in situ on the substrate layer; and reacting the metal layer to form a primary explosive layer. The method and apparatus formed thereby integrates fabrication of a micro-detonator in a monolithic MEMS structure using "in-situ" production of the explosive material within the apparatus, in sizes with linear dimensions below about 1 mm. The method is applicable to high-volume low-cost manufacturing of MEMS safety-and-arming devices. The apparatus can be initiated either electrically or mechanically at either a single point or multiple points, using energies of less than about 1 mJ.

6 Claims, 5 Drawing Sheets

INTEGRATED THIN FILM EXPLOSIVE MICRO-DETONATOR

The present Application is a Divisional Application of U.S. patent application Ser. No. 10/729,266 filed on Dec. 3, 2003.

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to explosive and ignition trains for safety-and-arming devices and in particular to explosive and ignition trains for use with microelectromechanical systems (MEMS) safety-and-arming devices.

MEMS safety-and-arming devices currently being conceived and developed require detonating sources of a size such that conventional detonator fabrication techniques cannot be practically and economically employed. The detonating sources for state of the art MEMS safety-and-arming devices preferentially employ a maximum size of one cubic millimeter (mm). By comparison, the smallest mechanical detonator ever to enter widespread production has a total volume of nearly 34 cubic mm with a maximum dimension of 3.5 mm. The present invention, utilizing high density primary explosives, typically contains less than 10 mg of energetic material. In addition, the present invention represents the smallest practical size of a self-contained device which could possibly initiate a secondary explosive a short distance away, yet be fabricated and housed within a MEMS device.

The problem of low-energy energetic devices of about one cubic mm in size is a generic one. Energetic devices of this size are required for the vast majority of MEMS safety-and-arming devices that are contemplated for use in submunitions and other low-cost, high-volume applications that require a detonating output stimulus. While substantial attentions have been directed towards the fabrication of MEMS sensors, mechanical actuators and mechanisms in recent years, little or no effort has been directed towards the exploration of the energetics technologies to produce and control a detonation in such systems.

On the other hand, for systems in which relatively large electrical energies are available, interrupted electrical slapper detonator systems have been shown to be feasible initiators. The small bridge and flyer sizes needed to directly initiate explosives such as HNS-IV, and the ever-decreasing sizes of the requisite capacitors and switches, allow the slapper to be fabricated within a MEMS-device relatively easily. In addition, the acceptor explosive remains in the "macro" world and can be fabricated using well-known explosive powder-pressing techniques. MEMS units can then simply provide mechanical interruption between the flyer plate and acceptor explosive pellet, or in the most general case, an in-line explosive train whose arming energies are properly controlled (in accordance with Mil-Std-1316D) can also be utilized. Such electrically driven slapper devices, while sufficiently small to be fabricated within a MEMS device, require high electrical power and moderate electrical energies. Such slapper devices are relatively complex and expensive to fabricate making them inappropriate for low-energy, low-cost, high-volume MEMS applications, or MEMS applications where little or no onboard electrical energy is available.

SUMMARY OF THE INVENTION

The present invention provides a method for making useful (detonating and non-detonating) explosive and ignition trains for incorporation into MEMS safety-and-arming devices. An important characteristic of the inventive explosive device is that it is capable of being initiated by a relatively low-energy mechanical or electrical stimulus. In addition, the methods of fabrication are compatible with MEMS materials and manufacturing processes. Such devices as the present invention may be fabricated in sizes with linear dimensions between about 0.1 mm and about 1 mm.

The present invention makes use of a thin layer of explosive to drive a thin flyer plate. The flyer plate is either deposited on top of the explosive layer or is formed by the explosive layer substrate. The explosive layer itself may be produced by a number of means.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention integrates fabrication of a micro-detonator in a monolithic MEMS structure using "in-situ" production of the explosive material within the device, in sizes with linear dimensions below about 1 mm. The invention is applicable to high-volume low-cost manufacturing of MEMS safety-and-arming devices. The inventive device can be initiated either electrically or mechanically at either a single point or multiple points, using energies of less than about 1 mJ.

The present invention reduces the use of toxic primary explosive materials, their starting materials, and detonation products (typically heavy metal salts) by nearly two orders of magnitude over currently employed macro-sized explosive trains. The invention thereby confers significant environmental advantages and assists in fulfilling Executive Order 12856, which mandates significant reductions in the use of environmentally toxic energetic materials. Toxic waste generation is concomitantly reduced.

The present invention removes the necessity for the synthesis, handling, loading, transportation, and storage of bulk quantities of sensitive primary explosive materials, since only the extremely small quantities of explosive needed to fulfill the explosive function are formed directly within the MEMS device. Such small quantities of explosive represent miniscule hazards in comparison to the macroscopic detonation systems currently employed. Loading, handling, transportation, and storage safety are thus significantly enhanced.

Figure 1A:
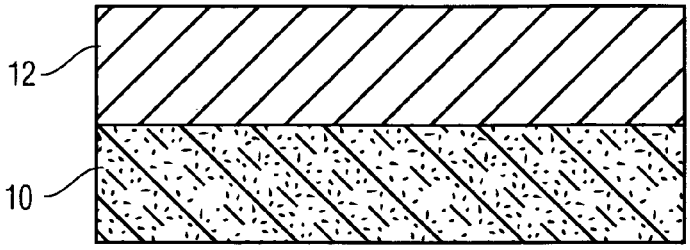
FIGS. 1A-1C are cross-sectional views that illustrate one embodiment of a method of making a thin film explosive micro-detonator.
Figure 1B:
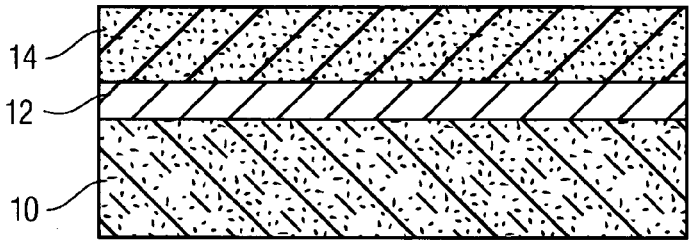

FIGS. 1A and 1B illustrate one embodiment of a method of making a thin film explosive micro-detonator. A substrate or base 10 is formed from, for example, silicon. A metal substrate 12 of an explosive cation is deposited in situ on the substrate 10. The metal substrate 12 may be formed by, for example, plasma vapor deposition, chemical vapor deposition or sputtering. Metal substrate 12 may comprise, for example, copper, nickel, cadmium or silver. The metal substrate 12 is then reacted with a gas or liquid phase reactant to form a primary explosive layer 14. The reaction or series of reactions in the gas or liquid phase are used to form a primary explosive layer 14 of the desired thickness. As an example, to form Cu(II) azide:

$$2Cu+2HN_3(gas)>>2CuN_3+H_2+Oxidizer>>CuO+Cu(N_3)_2+H_2O$$

Although copper azide is indicated for the purposes of example, alternative primary explosive layers, such as nickel azides, cadmium azides, silver azides, fulminates, and other explosive salts which can be formed "in-situ" may be similarly employed.

Figure 1C:
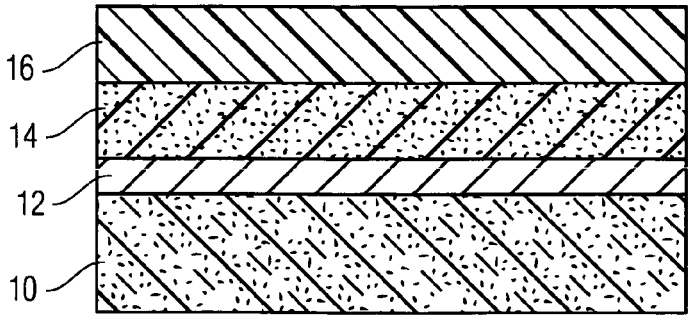
Figure 2:
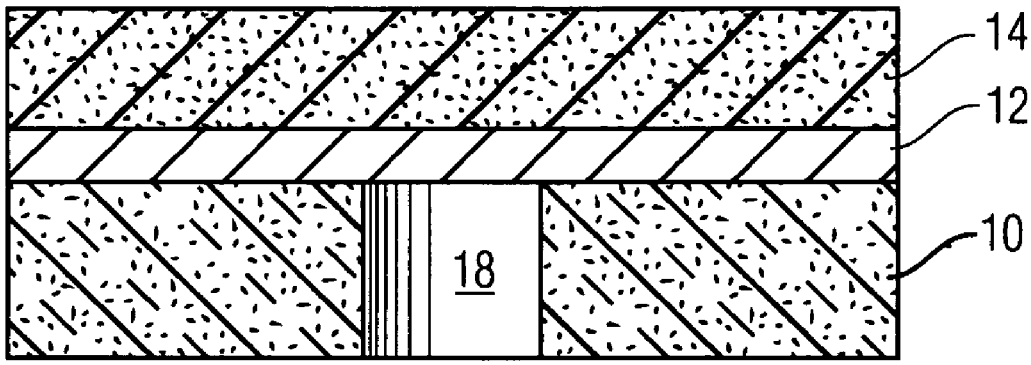
FIG. 2 is a cross-sectional view that shows an alternative method for forming a flyer plate.

In FIG. 1C, an organic flyer plate 16 is deposited on top of the explosive layer 14. FIG. 2 shows an alternative method for forming a flyer plate. In FIG. 2, the apparatus of FIG. 1B is modified by etching a hole or barrel 18 on the back side of substrate 10. The unreacted metal substrate 12 then functions as a flyer plate driven by the explosive layer 14 through the barrel 18.

Figure 3B:
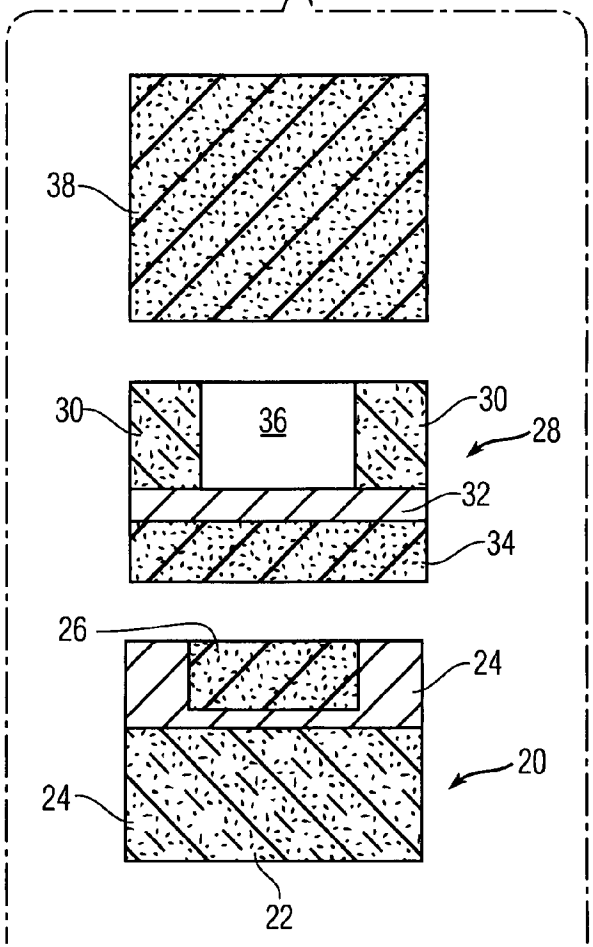
FIGS. 3A and 3B are cross-sectional views that illustrate one embodiment of an explosive train utilizing a detonator according to the invention.
Figure 3A:
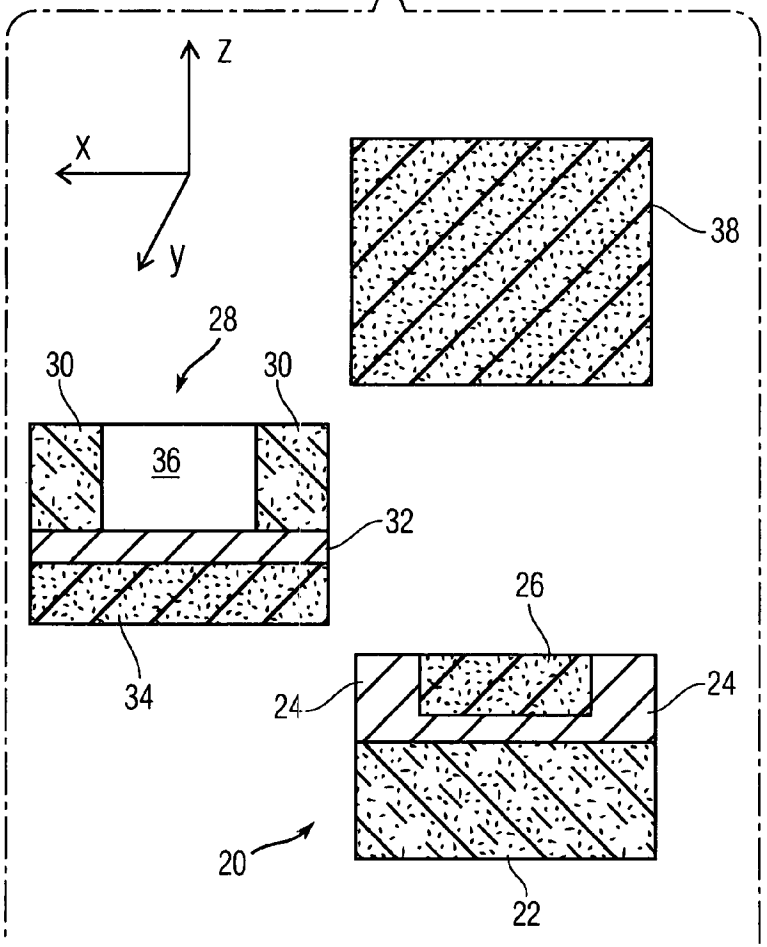

FIGS. 3A and 3B illustrate one embodiment of an explosive train made according to the above-described method. FIG. 3A is the "safe" position and FIG. 3B is the "armed" position. A fixed initiation element 20 comprises a base or substrate layer 22 (for example, silicon), an unreacted metal substrate 24 and primary explosive layer 26. A mobile slider element 28 comprises a substrate layer 30 (for example, silicon), an unreacted metal substrate 32 and primary explosive layer 34. Mobile slider element 28 moves along the x-axis from the "safe" to the "armed" position. The mobile slider element 28 uses the unreacted metal substrate 32 as a flyer element. A hole or barrel 36 is etched into the back side of the silicon substrate 30. Following initiation of the explosive element 26 in the "armed" position, the explosive element 34 in the mobile slider is initiated by air shock, in close proximity to the fixed explosive element 26. At detonation, a portion of the unreacted metal substrate 32 flies through barrel 36 to initiate acceptor explosive 38, which is typically comprised of a suitably insensitive secondary explosive, such as RDX, HNS, or PETN, or a suitable formulation thereof, such as PBXN-5, PBXN-7, or PBXN-301.

Although not shown in FIGS. 3A and 3B for the sake of simplicity, the fixed element 20 is mechanically blocked by a solid portion of the slider element 28 when in the safe position. Alternatively, the solid portion of the slider element 28, may be designed to contain an "energy trap", which serves to partially absorb and dissipate energies produced by the fixed explosive element 26 while in the "safe" condition. Initiation and growth to detonation requires that the fixed and mobile elements 20, 28 are in alignment in order to achieve sufficient overall reaction run length to drive the flyer plate 32 to requisite velocity to initiate the acceptor explosive 38. Again, though not shown for the sake of simplicity, all exposed explosive elements are sealed or encapsulated by a thin passivation layer after they have been fabricated, for protection, robustness, and mechanical integrity.

The combined amount of primary explosive 26 and primary explosive 34 is preferably no more than about 10 milligrams. Given the maximum heat of explosion available from primary explosive materials as 2-4 kJ/gm, a maximum of 20 J to 40 J of thermochemical energy is available from the device. Much of this energy would not be available to, for example, accelerate a flyer plate. However, provided that requisite flyer velocities are achieved (approx. 2.5 km/sec) for prompt initiation, flyer kinetic energies less than 100 mJ are adequate to initiate explosives such as HNS-IV (250μ spot size). In the case that flyer velocities on the order of 2.5 km/sec cannot be achieved, it is possible to some extent to compensate by using a flyer plate 32, which is thicker, or which has an optimal shock impedance and geometry for initiation of the acceptor explosive 38.

The key to achieving initiation is choosing a combination of flyer mass and velocity which makes the most efficient use of the available explosive driver energy, and satisfies the short-pulse shock initiation criteria for the acceptor explosive chosen. Flyer velocities achieved with thin-layer explosive systems may be less than those of typical electrical slapper detonators. Therefore, thicker, more massive flyers may be needed to achieve reliable initiation. The combined size of the mobile slider element 28 and the fixed initiator element 20 is preferably no greater than about one cubic millimeter.

Figure 4A:
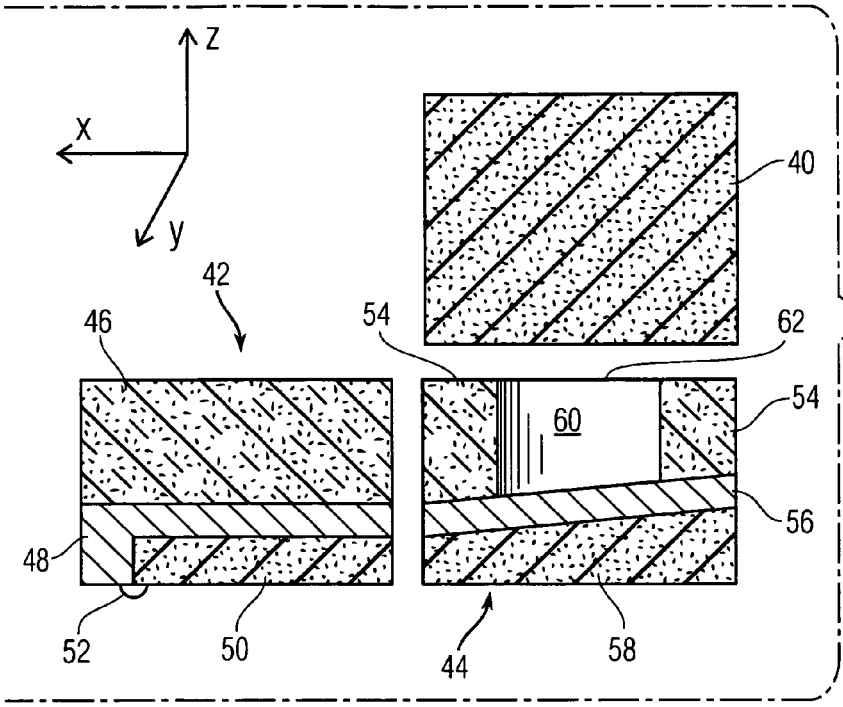
FIG. 4A is a cross-sectional view of another embodiment of an explosive train utilizing a detonator according to the invention.
Figure 4B:
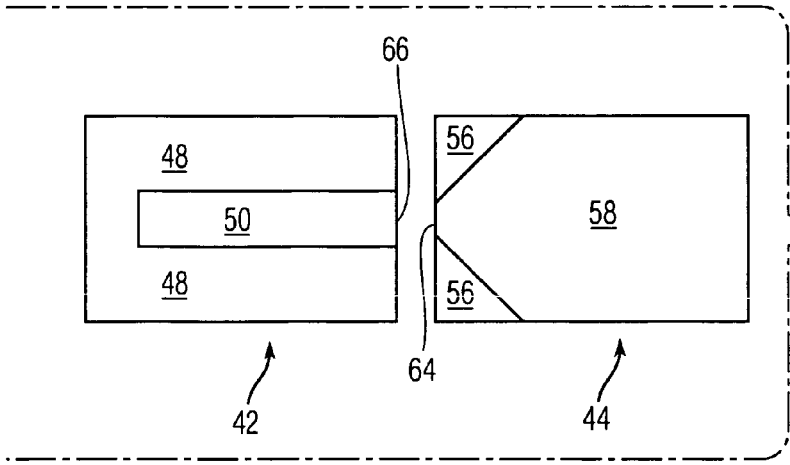
FIG. 4B is a bottom view of FIG. 4A.

FIG. 4A is a cross-sectional view of another embodiment of an explosive train made according to the above-described method. FIG. 4B is a bottom view of FIG. 4A. The embodiment of FIGS. 4A-B has the advantage of a lower L/D ratio than the embodiment of FIGS. 3A-B. Referring to FIGS. 4A-B, the detonator comprises a fixed initiator element 42, an acceptor explosive 40 and a mobile slider element 44. Fixed initiator element 42 comprises a base layer 46 (for example, silicon), an unreacted metal substrate layer 48 and a primary explosive layer 50. As seen in FIG. 4B, primary explosive layer 50 is surrounded on its sides and top by unreacted metal substrate layer 48. A preferred initiation point is indicated by numeral 52.

Mobile slider element 44 is movable between an unarmed position that is remote from the fixed initiator element 42 and the acceptor explosive 40 and an armed position that is adjacent the fixed initiator element 42 and the acceptor explosive 40. FIGS. 4A-B show the mobile slider element 44 in the armed position. Mobile slider element 44 moves on the y-axis shown in FIG. 4A.

Mobile slider element 44 comprises a base layer 54 (for example, silicon), an unreacted metal substrate layer 56 and a generally wedge shaped primary explosive layer 58. The base layer 54 includes a barrel 60 formed therein. An open end 62 of the barrel 60 is adjacent the acceptor explosive 40 when the mobile slider element 44 is in the armed position, as in FIGS. 4A-B. A narrow end 64 of the generally wedge shaped primary explosive layer 58 of the mobile slider element 44 is adjacent an end 66 of the primary explosive layer 50 of the fixed initiator element 42 when the mobile slider element 44 is in the armed position, as in FIGS. 4A-B.

A combined amount of primary explosive 58, 50 in the mobile slider element 44 and the fixed initiator element 42 is preferably no greater than about ten milligrams. A combined size of the mobile slider element 44 and the fixed initiator element 42 is preferably no greater than about one cubic millimeter. Initiation of the fixed initiator element 42 at a single point 52 shown on FIG. 4A is expanded by the wedge-shaped thin explosive layer 58 (along the x-axis) to form a (curved) line generator. As the initiation sweeps across the underside of the flyer plate (unreacted substrate layer 56), the unreacted substrate layer 56 is accelerated upward (along the z-axis) starting at the left and moving towards the right, in such a way that the flyer motion is ultimately planar, as it moves down the barrel 60 of the mobile slider element 44 and strikes the acceptor explosive 40.

Figure 5A:
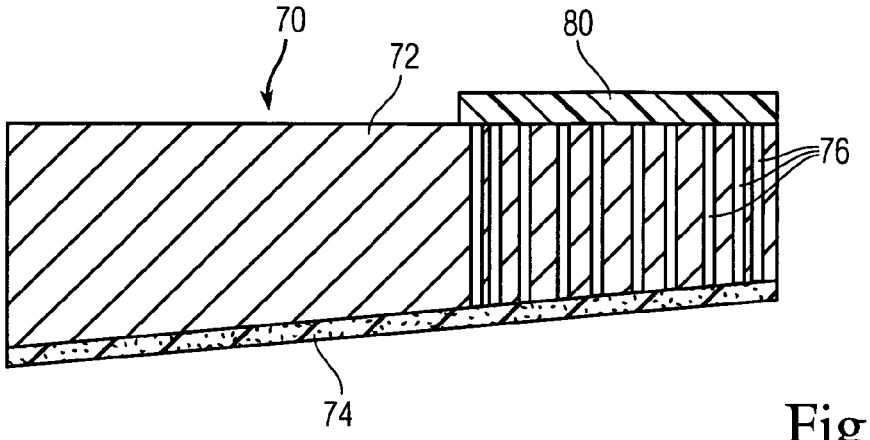
FIG. 5A is a cross-sectional view of another embodiment of a detonator according to the invention.
Figure 5C:
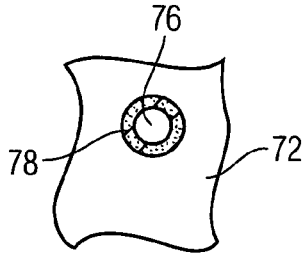
FIG. 5C is an enlarged section view of a through hole.
Figure 5B:
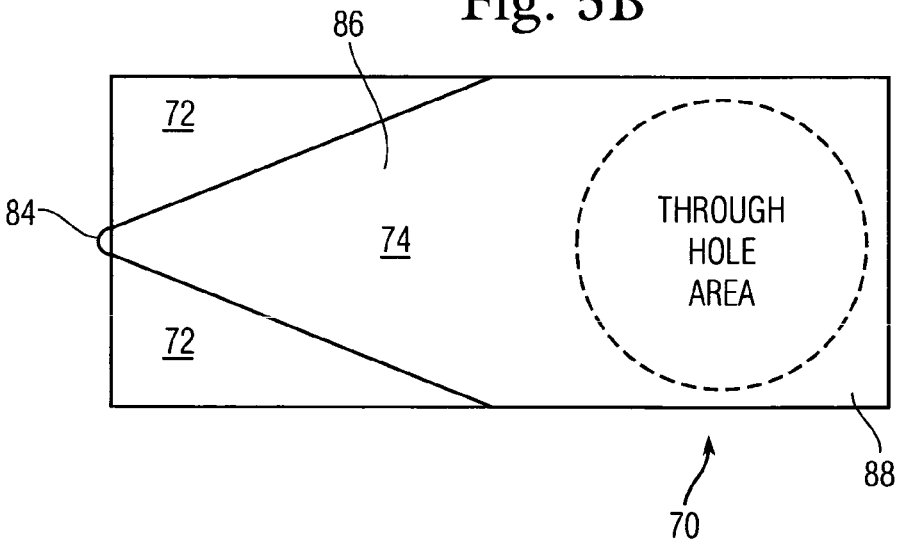
FIG. 5B is a bottom view of FIG. 5A.

FIG. 5A is a cross-sectional view of another embodiment of a detonator 70 made according to the above-described method. FIG. 5B is a bottom view of FIG. 5A. Detonator 70 is an initiator only, not the complete explosive train in which it would be used. Detonator 70 comprises a base layer 72 made of, for example, silicon. A primary explosive layer 74 is disposed on one side of the base layer 72 (the underside as shown in FIGS. 5A-B). The primary explosive layer 74 is formed by the method described above, that is, a metal substrate of an explosive cation is deposited in situ on the base layer 72. The metal substrate is then reacted with material(s) in the gas or liquid phase to form the primary explosive layer 74.

The primary explosive layer 74 has a wedge shaped portion 86 and a rectangular shaped portion 88. A dense plurality of through holes 76 are formed in the base layer 72 adjacent the rectangular shaped portion 88 of the primary explosive layer 74. FIG. 5C is an enlarged section view of a through hole 76. Each through hole 76 includes a primary explosive layer 78 on its interior surface. The primary explosive layers 78 on the interior of the through holes 76 are formed by the method described above, that is, a metal substrate of an explosive cation is deposited in situ on the through hole base layer. The metal substrate is then reacted with material(s) in the gas or liquid phase to form the primary explosive layer 78.

An organic flyer plate 80, typically composed of parylene, polyimide, or other suitable polymer is disposed on a side of the base layer 72 opposite the primary explosive layer 74. Organic flyer plate 80 covers the through holes 76 formed in the base layer 72. An amount of primary explosive 74, 78 is no greater than about ten milligrams. A size of the detonator 70 is no greater than about one cubic millimeter. The organic flyer plate 80 is launched using the primary explosives 78 which are formed in situ on the inner surfaces of the through holes 76 in the base layer 72. A similar line generator/plane-wave generator to that in FIGS. 4A-B allows the launch of a substantially flat flyer plate. In this case, it is expected that the drive impulse imparted to the flyer plate 80 would be of lower pressure and longer duration than in FIGS. 4A-B, due to the physics of channel effect propagation. Therefore, a thicker flyer plate may be necessary, and a longer acceleration distance may also be required. The flyer plate 80 may alternatively utilize metals, ceramics, or a combination of organics, metals, and ceramics, in order to remain intact after launch, and to subsequently effect optimal shock energy transfer to an acceptor explosive (not shown in FIG. 5.)

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An explosive train, comprising:

a fixed initiator element comprising a base layer, an unreacted metal substrate layer and a primary explosive layer;

an acceptor explosive; and a mobile slider element being movable between an unarmed position that is out of line with the fixed initiator element and the acceptor explosive and an armed position that is in line with the fixed initiator element and the acceptor explosive, wherein the mobile slider element is comprised of a base layer, an unreacted metal substrate layer and a primary explosive layer, the base layer including a barrel formed therein, wherein an open end of the barrel is adjacent the acceptor explosive when the mobile slider element is in the armed position, and wherein the primary explosive layer of the mobile slider element is adjacent the primary explosive layer of the fixed initiator element when the mobile slider element is in the armed position.

2. The explosive train of claim 1, wherein a combined amount of primary explosive in the mobile slider element and the fixed initiator element is no greater than about ten milligrams.

3. The explosive train of claim 1, wherein a combined size of the mobile slider element and the fixed initiator element is no greater than about one cubic millimeter.

4. An explosive train, comprising:

a fixed initiator element comprising a base layer, an unreacted metal substrate layer and a primary explosive layer;

an acceptor explosive; and a mobile slider element being movable between an unarmed position that is remote from the fixed initiator element and the acceptor explosive and an armed position that is adjacent the fixed initiator element and the acceptor explosive, wherein the mobile slider element is comprised of a base layer, an unreacted metal substrate layer and a generally wedge shaped primary explosive layer, the base layer includes a barrel formed therein, wherein an open end of the barrel is adjacent the acceptor explosive when the mobile slider element is in the armed position, and wherein a narrow end of the generally wedge shaped primary explosive layer of the mobile slider element is adjacent an end of the primary explosive layer of the fixed initiator element when the mobile slider element is in the armed position.

5. The explosive train of claim 4, wherein a combined amount of primary explosive in the mobile slider element and the fixed initiator element is no greater than about ten milligrams.

6. The explosive train of claim 4, wherein a combined size of the mobile slider element and the fixed initiator element is no greater than about one cubic millimeter.

* * * * *